US005749789A

United States Patent [19]

Karl

[11] Patent Number: 5,749,789

[45] Date of Patent: May 12, 1998

[54] PORTABLE MINIATURE GOLF GAME

[76] Inventor: James S. Karl, 2731 Ross Rd., Palo Alto, Calif. 94303

[21] Appl. No.: 695,919

[22] Filed: Aug. 12, 1996

[51] Int. Cl.[6] ..... A63B 67/02

[52] U.S. Cl. ..... 473/162; 473/158

[58] Field of Search ..... 473/162, 158, 473/157, 159–161, 171

[56] References Cited

U.S. PATENT DOCUMENTS

| | | | |
|---|---|---|---|
| 1,582,237 | 4/1926 | Angell | 473/158 |
| 3,038,726 | 6/1962 | Hesidence | 273/176 |
| 3,323,802 | 6/1967 | Riner | 273/176 |
| 3,669,454 | 6/1972 | Kolonel | 473/162 |
| 3,735,988 | 5/1973 | Palmer et al. | 473/162 |
| 3,909,006 | 9/1975 | Arbaugh | 273/176 AA |
| 4,244,576 | 1/1981 | Mosier et al. | 273/176 F |
| 4,275,886 | 6/1981 | Bannon | 273/178 R |
| 4,596,391 | 6/1986 | Carolan, Jr. | 473/158 |
| 4,755,401 | 7/1988 | Friedrich et al. | 428/17 |
| 4,850,594 | 7/1989 | Manzione | 473/162 |
| 4,875,680 | 10/1989 | Gross | 273/87 B |
| 4,877,250 | 10/1989 | Centafanti | 473/157 |
| 4,988,106 | 1/1991 | Coonrod | 473/162 |

*Primary Examiner*—Mark S. Graham

[57] ABSTRACT

A portable miniature golf game to be played with a putter and ball having multiple, flexible retaining rails, obstacles, and a ball receptacle which are attachable to multiple putting mats arranged in desired abutting relationships. Each of the putting mats has a top-playing surface of loop-like fibers which are suitable for interlocking engagement with hook-like projections incorporated into the base surface of each retaining rail and obstacle. The hook-like projections are disposed on mount devices that are interconnected with each retaining rail and obstacle. The number and distribution of mount devices interconnected with each retaining rail and obstacle is dependent on the size of each retaining rail and obstacle. The ball receptacle may be disposed on any desired location on any putting mat, and the retaining rails and obstacles may be detachably attached to the putting mats at any desired location to form various miniature golf hole configurations.

16 Claims, 8 Drawing Sheets

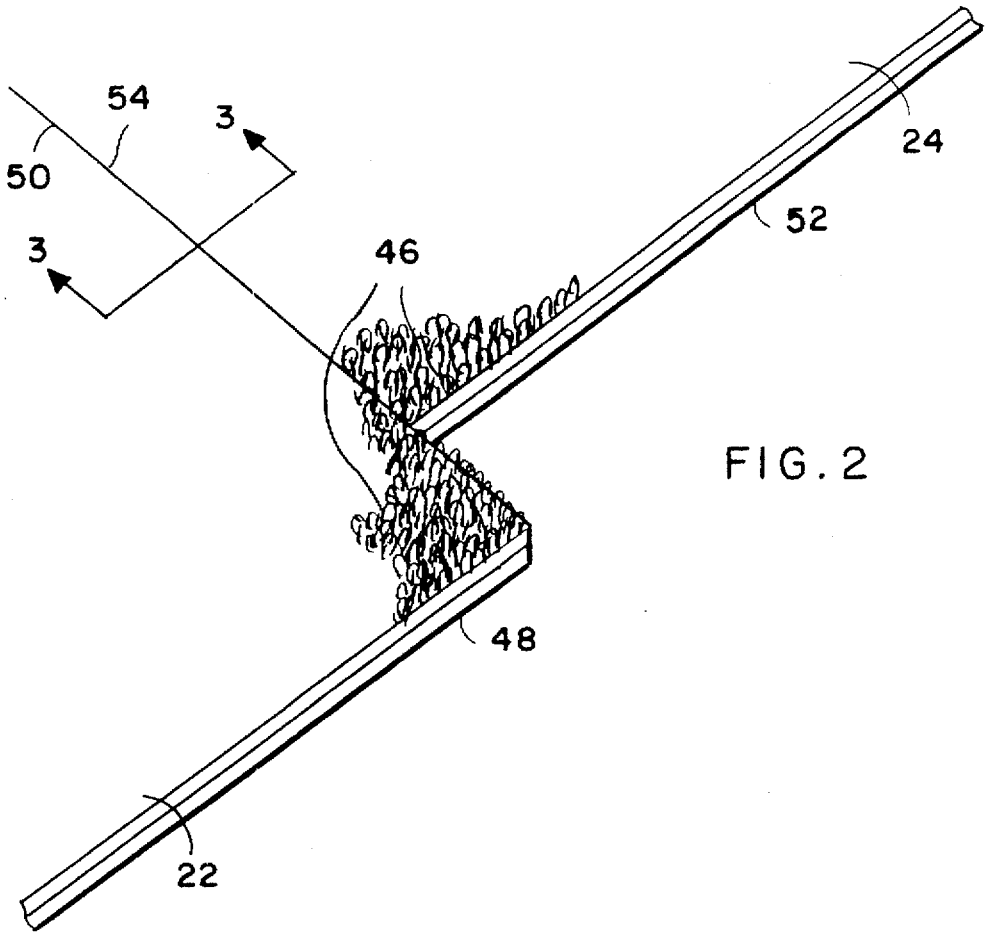
FIG. 2
FIG. 3
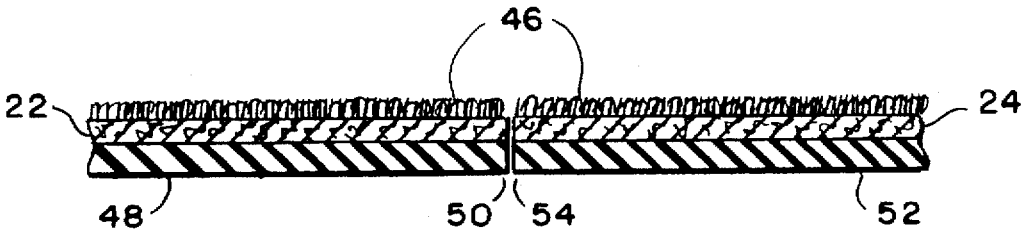

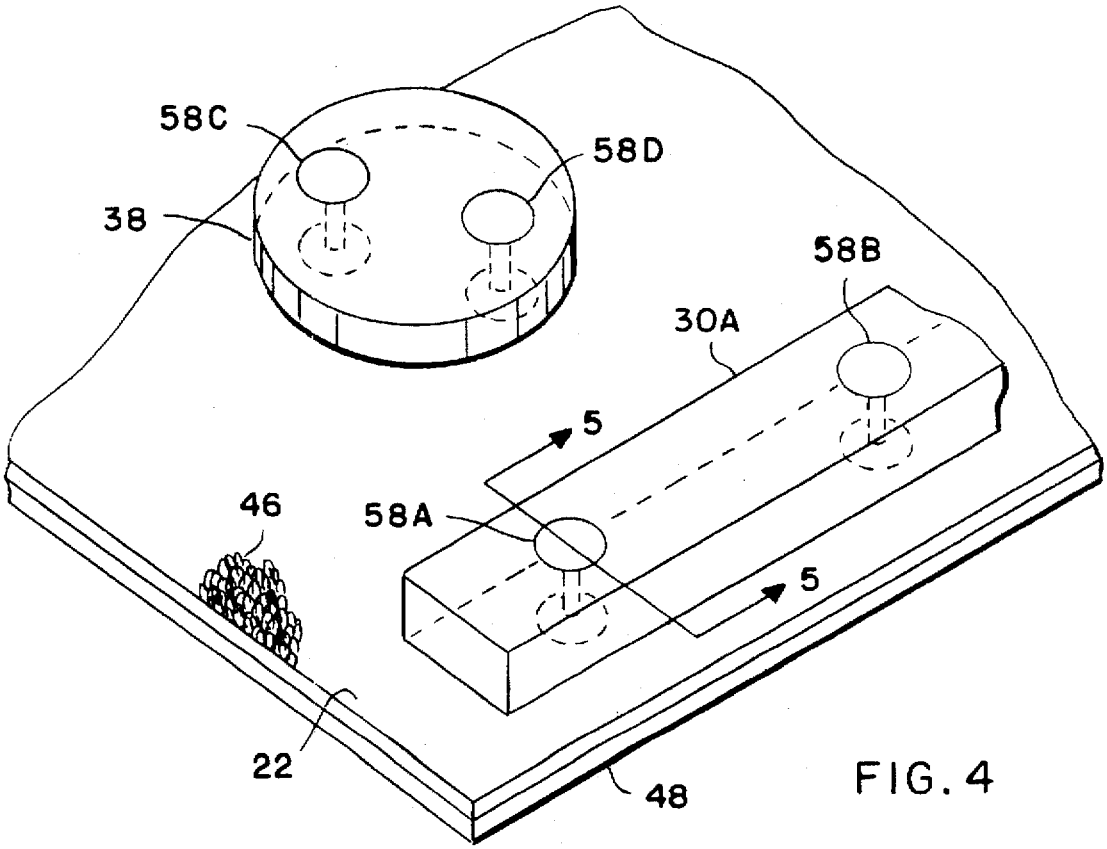
FIG. 4
FIG.5A
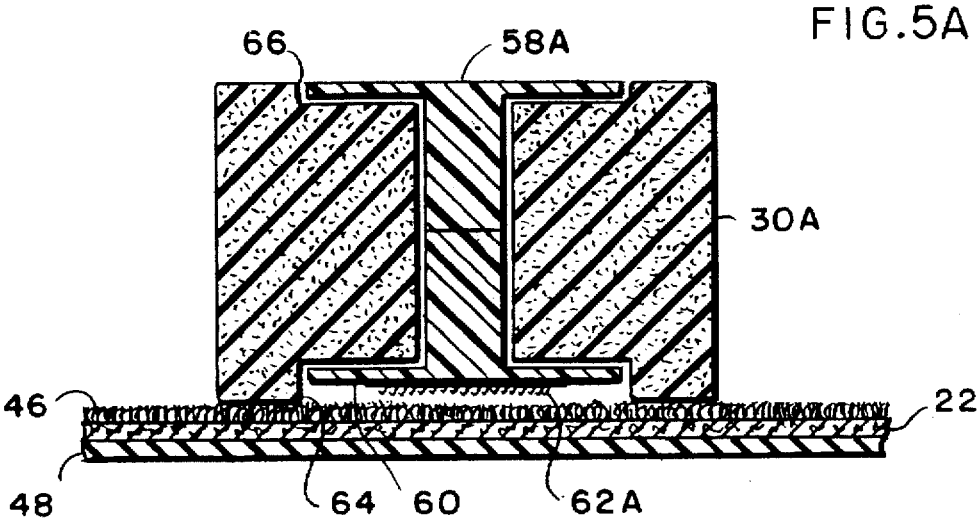

PORTABLE MINIATURE GOLF GAME

This invention relates to miniature golf, specifically to a portable miniature golf game that can be played in a variety of configurations and locations.

BACKGROUND OF THE INVENTION

Miniature golf courses of various sizes, types, and designs for indoor and outdoor play, so popularized by vacation resorts and amusement parks, are well known in the art. Unfortunately, the enjoyment of this widespread game is typically limited to playing on commercial courses. Therefore, various smaller, portable versions of the popular game have been developed. For example, U.S. Pat. No. 4,877,250 to Centafanti discloses a portable golf putting course including a retaining rail that is secured to a playing surface by sections of hook and loop fasteners. This means of fastening can include spaced sections of hook or loop fasteners that are disposed on the retaining rail, and these fasteners correspondingly attach directly with spaced sections of mating fasteners that are disposed on the playing surface. However, the spaced fasteners are disposed at predetermined locations on the retaining rail as well as on the playing surface. Therefore, the positioning of the retaining rail on the playing surface is substantially limited.

U.S. Pat. No. 3,735,988 to Palmer et al. discloses a practice putting surface with retaining rails that can be attached to the sides of a base portion underneath the putting surface. However, the retaining rails are substantially limited to attachment only on the outer edge of the base portion.

U.S. Pat. No. 4,244,576 to Mosier et al. discloses a golf practice apparatus that includes a putting green mat with a top surface of loop-like fibers which are capable of interlocking engagement with hook-like projections disposed on a lighter-than-regulation-weight golf ball in order to restrict the movement of the golf ball as it travels across the top surface of the putting green mat. However, this apparatus does not disclose the use of obstacles or retaining rails.

U.S. Pat. No. 4,596,391 to Carolan, Jr. discloses a portable golf game that includes obstacles to be placed at various locations on the playing surface. In a preferred embodiment, the obstacles are relatively heavy to resist movement when struck by a golf ball. Brief reference is made to several optional attachment means for the obstacles, including hook and loop fasteners; however, no detailed embodiments of the optional fastening means are disclosed.

The above described games typically have several constraints on the number and type of possible configurations. Consequently, they limit a player's creativity in designing challenging and amusing miniature golf holes. For example, the descriptions of the above described games do not disclose detailed embodiments that offer a player the capability of creating easily modifiable and unique golf hole configurations by attaching retaining rails and obstacles anywhere the player desires on the playing surface. Therefore, there remains a need for a portable miniature golf game that provides for a variety of hole configurations by allowing a player to easily attach obstacles and retaining rails to any location on the playing surface, as well as place a golf ball receptacle on any location of the playing surface.

SUMMARY OF THE INVENTION

The present invention relates to a portable miniature golf game wherein a variety of golf hole configurations may be created through the use of multiple putting mats arranged in various abutting relationships in combination with multiple retaining rails, obstacles, and at least one ball receptacle. Each of the putting mats has a top playing surface of loop-like fibers which are suitable for interlocking engagement with hook-like projections disposed on at least one mount device incorporated into each retaining rail or obstacle. The ball receptacle may be disposed on any desired location on any putting mat, and the retaining rails and obstacles may be detachably attached to the putting mats at any desired location to form various miniature golf hole configurations.

OBJECTS AND ADVANTAGES

Accordingly, several objects and advantages of the present invention are:

(a) to provide a portable miniature golf game for use indoors or outdoors;

(b) to provide a portable miniature golf game wherein a variety of playing surface configurations can be created;

(c) to provide a portable miniature golf game which offers many different assembly options and many different levels of difficulty of play to miniature golf players of all skill levels;

(d) to provide a portable miniature golf game that can be played within different space accommodations on a variety of ground support surfaces such as tile floors, wood floors, carpet floors, cement, asphalt, and other suitable surfaces;

(e) to provide a portable miniature golf game with a lightweight, flexible playing surface that may easily be laid flat in an operative playing position or may be rolled up into a compact storage position;

(f) to provide a portable miniature golf game wherein obstacles and retaining rails may be detachably attached to any location on the playing surface;

(g) to provide a portable miniature golf game wherein a ball receptacle may be placed on any location of the playing surface;

(h) to provide a portable miniature golf game with a ball receptacle and a plurality of obstacles and retaining rails which may be easily assembled with the playing surface to define one or more miniature golf holes, and just as easily disassembled for storage or transportation in a minimum of space; and (i) to provide a portable miniature golf game wherein a player may slightly alter a previously created miniature golf hole configuration by moving one or more members of the apparatus, or alternatively disassemble the entire configuration to create and assemble a new unique configuration.

Further objects and advantages of the present invention will become apparent from a consideration of the following description and drawings.

BRIEF DESCRIPTION OF THE DRAWINGS

FIG. 2 is a perspective view illustrating portions of two putting mats in abutting relationship.

FIG. 3 is a cross-sectional view taken along line 3—3 of FIG. 2 illustrating two putting mats in abutting relationship.

FIG. 4 is a perspective view illustrating a retaining rail and an obstacle disposed on a putting mat.

FIG. 5A is a cross-sectional view taken along line 5—5 of FIG. 4 illustrating a retaining rail in a latent, unattached state disposed on a putting mat.

DETAILED DESCRIPTION

Figure 1:
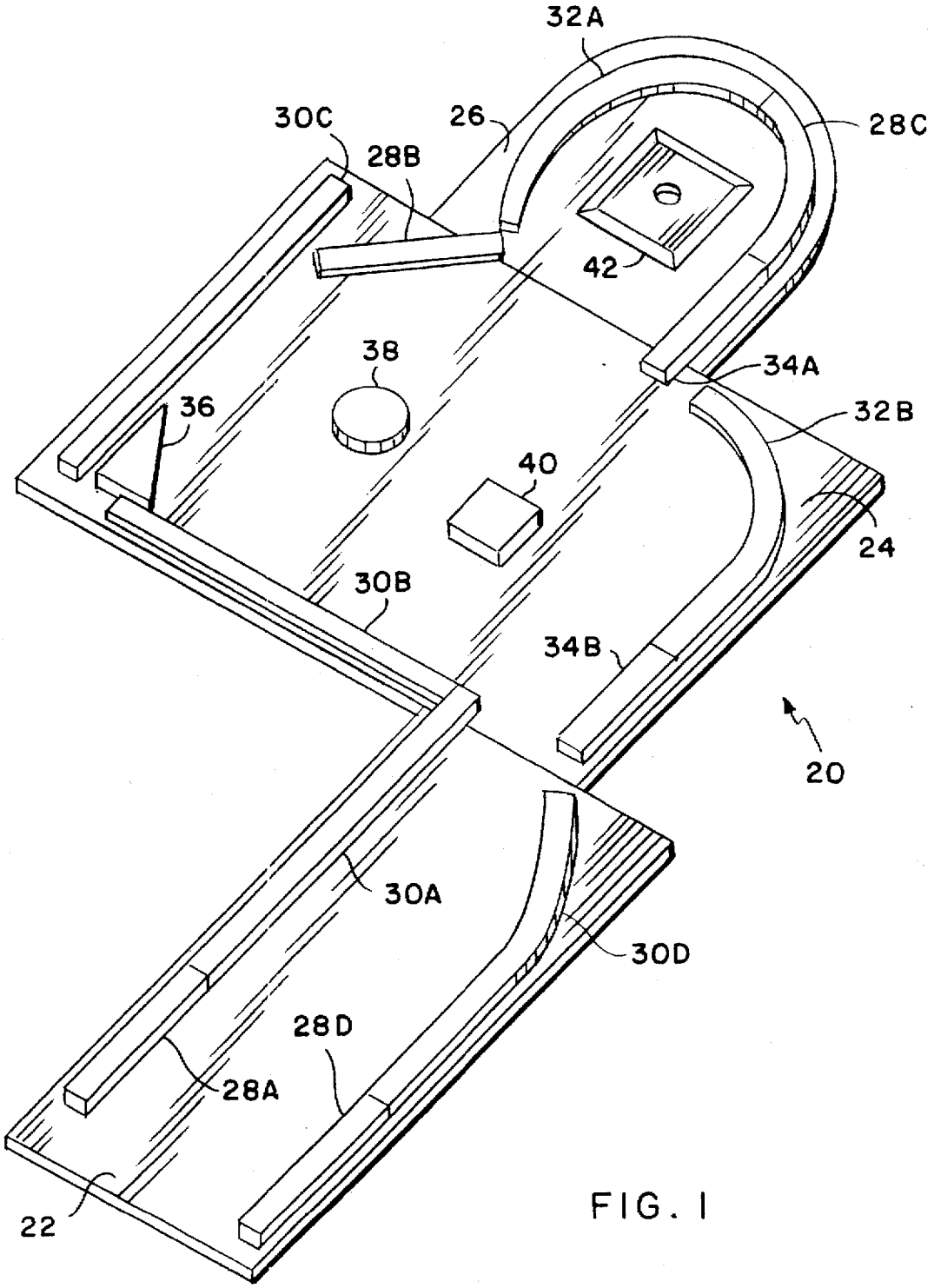
FIG. 1 is a perspective view illustrating one of many possible embodiments of a miniature golf hole according to the present invention.

Referring to FIG. 1, there is illustrated one of many possible embodiments of a miniature golf hole 20. It includes three putting mats 22,24, and 26 providing a playing surface. Attached to putting mats 22, 24, and 26 are twelve retaining rails 28A, 28B, 28C, 28D, 30A, 30B, 30C, 30D, 32A, 32B, 34A, and 34B mainly used to contain and guide the ball along the playing surface. Attached to putting mat 24 are three obstacles 36, 38, and 40 of various shapes which are placed on the playing surface to vary the level of difficulty of play. Disposed on putting mat 26 is a ball receptacle 42.

In the preferred embodiment, the retaining rails and obstacles are made of a flexible material such as polyurethane foam which allows for manipulation into various configurations. Retaining rails 28A, 28B, 28C, and 28D illustrate retaining rails of the same length, preferably 24 inches. Retaining rails 30A, 30B, 30C, and 30D illustrate retaining rails of the same length, preferably 48 inches. Retaining rails 32A and 32B illustrate retaining rails of the same length, preferably 42 inches. Retaining rails 34A and 34B illustrate retaining rails of the same length, preferably, 18 inches. Of course, retaining rails may be of various lengths to accommodate putting mats of different sizes. Retaining rails 28A, 28B, 28D, 30A, 30B, 30C, 34A, and 34B illustrate retaining rails in straight form. Retaining rails 28C, 30D, 32A, and 32B illustrate retaining rails in a manipulated, curved form. Optionally, retaining rails may be used as obstacles and various shaped obstacles may be used to help retain the ball within any hole configuration.

In the preferred embodiment, the game is to be played with a polyurethane foam ball and a plastic putter. However, any suitable ball and club combination, including an official golf ball and putter, may be used.

In FIG. 2 there is illustrated a portion of putting mats 22 and 24 which may be of various sizes and shapes. In the preferred embodiment putting mat 22 is preferably 2 feet wide and 6 feet long and putting mat 24 is preferably 4 feet wide and 6 feet long. Putting mats 22 and 24 include top surfaces of loop-like fibers 46 which preferably extend over the entire surface of each mat and are arranged in close proximity to one another in order to simulate a playing surface of a typical miniature golf course hole. The loop-like fibers of the putting mats must be suitable for interlocking engagement with hook-like projections incorporated into obstacles and retaining rails as shown in, for example, FIG. 5B, and these loop-like fibers form a uniform surface that allows for a true roll of the ball. A suitable material for such a mat is automotive and marine fabric such as 'Lakeside 19184' manufactured by General Felt Industries and distributed by Coast Fabrics of Sacramento, Calif. This fabric includes a latex backing that supports a fiber construction of 100% solution dyed polyester. While a particular fabric has been identified, there are a number of materials which are also suitable for interlocking with hook-like projections. Such materials are considered to have loop-like fibers.

Putting mat 22 includes a flexible, non-skid backing 48 and a marginal edge 50. Similarly, putting mat 24 includes a flexible, non-skid backing 52 and a marginal edge 54. Backings 48 and 52 are of a non-skid type that restrict movement when putting mats are placed upon a ground or floor surface and are fixedly secured to putting mats 22 and 24 respectively. In the preferred embodiment the backings for the putting mats are made of a flexible, non-skid material such as rubber with a 60 durometer rating, foam rubber with fiber reinforcement, or vinyl; although there are a number of suitable materials.

FIG. 2 further illustrates mats 22 and 24 in abutting relationship at marginal edges 50 and 54 respectively. This abutment forms a playing surface that allows for a sustained roll of a ball from one putting mat to another.

In FIG. 3 there is illustrated a cross-sectional view in detail of FIG. 2 showing putting mats 22 and 24 in abutting relationship. Putting mats 22 and 24 include a top surface of loop-like fibers 46. Putting mat 22 includes a flexible, non-skid backing 48 and a marginal edge 50. Similarly, putting mat 24 includes a flexible, non-skid backing 52 and a marginal edge 54. Putting mats 22 and 24 are shown in abutting relationship at marginal edges 50 and 54 respectively. This abutment forms a playing surface that allows for sustained rolling of a ball from one putting mat to another. Putting mats may also be arranged in abutting relationship in a detachably attached manner by using hook and loop fastener strips or various other methods. This provides a stronger attachment of one mat to another, but is not typically required because the non-skid backings 48 and 52 prevent the mats from moving on most surfaces.

In FIG. 4 there is illustrated putting mat 22, retaining rail 30A, and obstacle 38. In the preferred embodiment, the retaining rail and obstacle are made of a flexible material such as 100% polyurethane foam, although any other material that can be repeatedly bent without fracturing may be used. In the preferred embodiment, the foam has approximately a 52 Indention Foot Deflection (IFD) firmness and a density of approximately 2.90 lbs/cubic foot. IDF reflects the pressure required to compress a 50 square inch surface area down 1 inch on a 4 inch thick by 15 inch square piece of foam. Each retaining rail preferably has a width greater than its height in order to provide a stable retaining rail and may be of any length suitable to accommodate different putting mats of various sizes. In the preferred embodiment, the rails have a width of 3 inches and a height of 2 inches. Obstacles are of various shapes and sizes and are suitable for varying the level of difficulty of play. Retaining rail 30A and obstacle 38 may be attached to loop-like fibers 46 of putting mat 22 using several mount devices 58A, 58B, 58C, and 58D which are of the type shown in FIG. 5B.

Figure 5B:
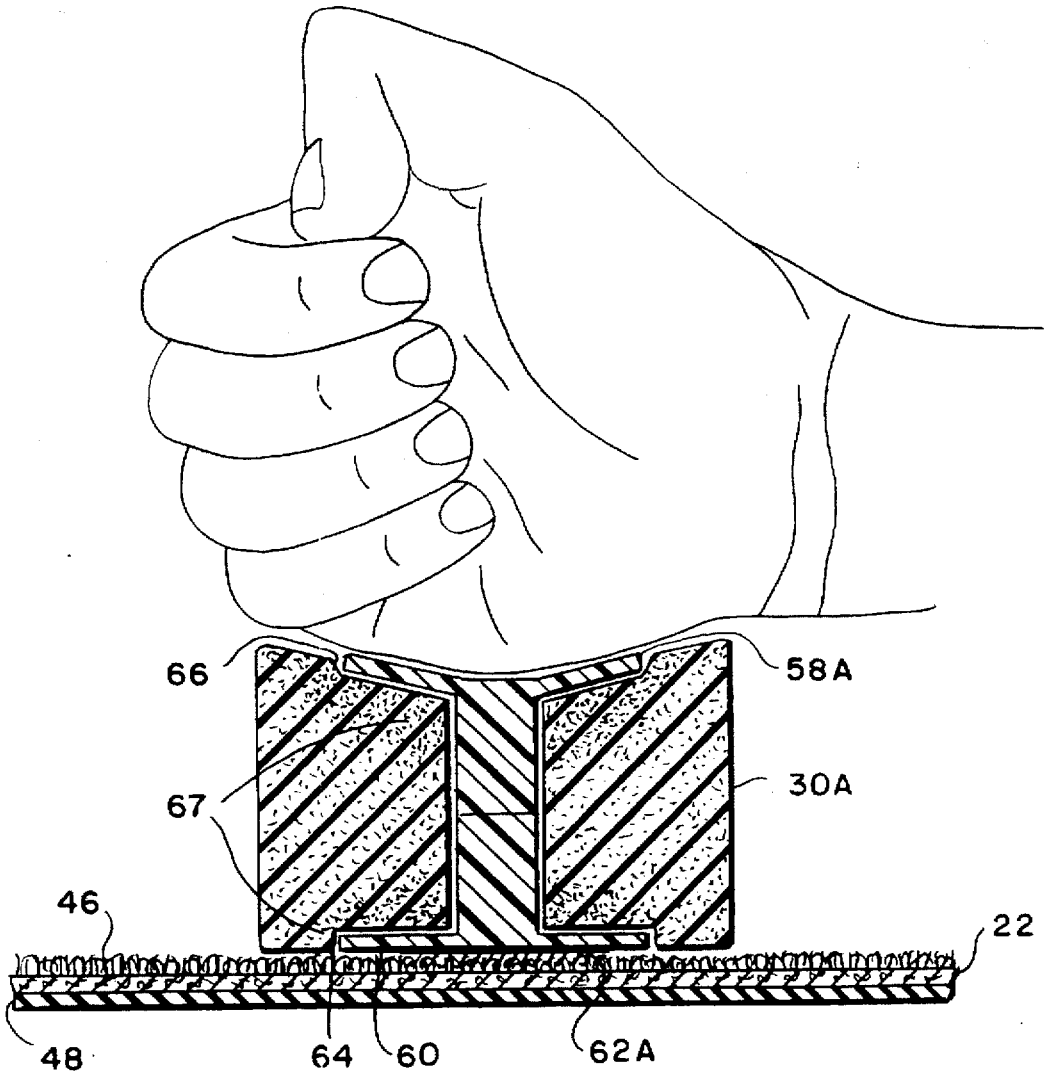
FIG. 5B is a cross-sectional view taken along line 5—5 of FIG. 4 additionally illustrating a mount device being compressed so as to engage its fasteners with the loop-like fibers of a putting mat.

FIG. 5A is a cross-sectional view taken along line 5—5 of FIG. 4 illustrating retaining rail 30A disposed on putting mat 22. Incorporated mount device 58A is shown in its latent, unattached state and has disposed on its underside 60 a plurality of hook-like projections 62A that are capable of interlocking with mating loop-like fibers 46 of putting mat 22. Hook-like projections 62A are preferably incorporated in a strip which is mounted to underside 60 with adhesives, although other mounting means, such as stitching, may be used. In the preferred embodiment, retaining rail 30A includes two circular recesses 64 and 66 which are used to accommodate mount device 58A. Mount device 58A is positioned in recess 64 in such a manner that hook-like projections 62A disposed on the underside 60 of mount device 58A do not interlock with loop-like fibers 46 of putting mat 22 until mount device 58A is temporarily depressed, as illustrated in FIG. 5B. In the preferred embodiment, recess 64 preferably has a depth of ⅜ of an inch. Recess 66 is an optional recess preferably having a depth of ⅛ of an inch and is used to snug mount device 58A into a position that places the top of mount device 58A level with the top of retaining rail 30A. Mount devices are used in a similar manner with obstacles as well.

The mount devices prevent damage to the retaining rails and obstacles by distributing the pressure exerted on the retaining rails and obstacles during their repeated removal from the putting mat. Disposing hook-like projections on each mount device eliminates the tearing damage that would otherwise occur to the retaining rails and obstacles if the hook-like projections were attached directly to the retaining rails and obstacles. The recesses on the underside of retaining rails and obstacles provide additional advantages. The recessed mount devices must be temporarily depressed to interlock the hook-like projections with the loop-like fibers. This results in a downward pressure being exerted by the top cap of the mount device on the retaining rails and obstacles and a resultant compressed region 67 as illustrated in FIG. 5B. This downward pressure results in a firmer attachment of retaining rails and obstacles to the putting mats. More specifically, retaining rails and obstacles attached in this manner are less prone to moving, flexing or twisting when struck by a golf ball. Because moving, flexing and twisting of the rails or obstacles absorbs energy from the golf ball, the absence of such movements results in a livelier bounce and a more enjoyable golf game. Another advantage of recesses is that retaining rails and obstacles may be placed on the putting mats without attachment until a desired location and configuration is chosen. Once a desired location and configuration is chosen, the mount devices may then be temporarily depressed resulting in interlocking attachment.

The degree of attachment of a retaining rail or an obstacle to a putting mat increases as the quantity of mount devices distributed throughout each retaining rail or obstacle increases. Because the present invention includes a playing surface of loop-like fibers, it offers the advantage of retaining rails and obstacles that may be attached to any desired location of the playing surface.

Figure 6A:
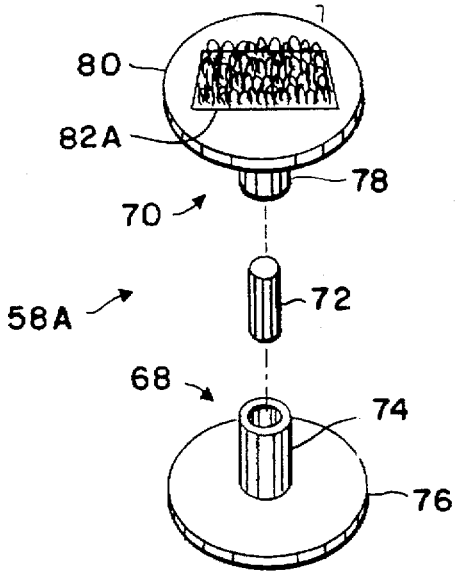
FIGS. 6A and 6B are exploded views illustrating one embodiment of a mount device used to support hook or loop fasteners.

In FIG. 6A there is illustrated an exploded view of mount device 58A comprising a base support 68, a top support 70, and a rod 72 connecting base support 68 to top support 70. In the preferred embodiment, base support 68 and top support 70 are of a flexible, rubber material construction similar to practice golf tees found at golf driving ranges and may be of any other material that can be repeatedly bent without fracturing. Rod 72 is preferably of a strong, resilient, but flexible material such as vinyl tubing or any other material that can be repeatedly bent without fracturing. While the preferred embodiment uses a rod 72 to connect base support 68 to top support 70, other connectors such as wire, plastic tabs, chain, or other connecting means will perform adequately.

Figure 6B:
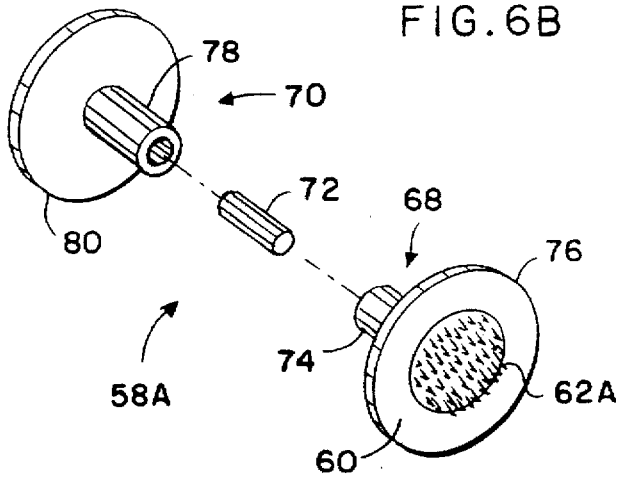

Base support 68 comprises a hollow neck 74 connected to a base cap 76. Base cap 76 has disposed on its underside a plurality of hook-like projections as shown in FIG. 6B. Top support 70 comprises a hollow neck 78 connected to a top cap 80. Top cap 80 has disposed on its top surface a plurality of loop-like fibers 82A. The function of loop-like fibers 82A is described in more detail in FIGS. 10 and 11. Rod 72 is constructed to allow for a snug fit when placed in hollow neck 74 and hollow neck 78. This fit may be improved upon through the use of adhesives. In the preferred embodiment, mount device 58A, when assembled, has a length of preferably 1.75 inches and base cap 76 and top cap 80 have a diameter of preferably 2 inches.

In FIG. 6B there is illustrated another exploded view of mount device 58A from a different perspective. Base cap 76 of base support 68 has disposed on its underside 60 a plurality of hook-like projections 62A which interlock with mating loop-like fibers of the putting mats.

Figure 7:
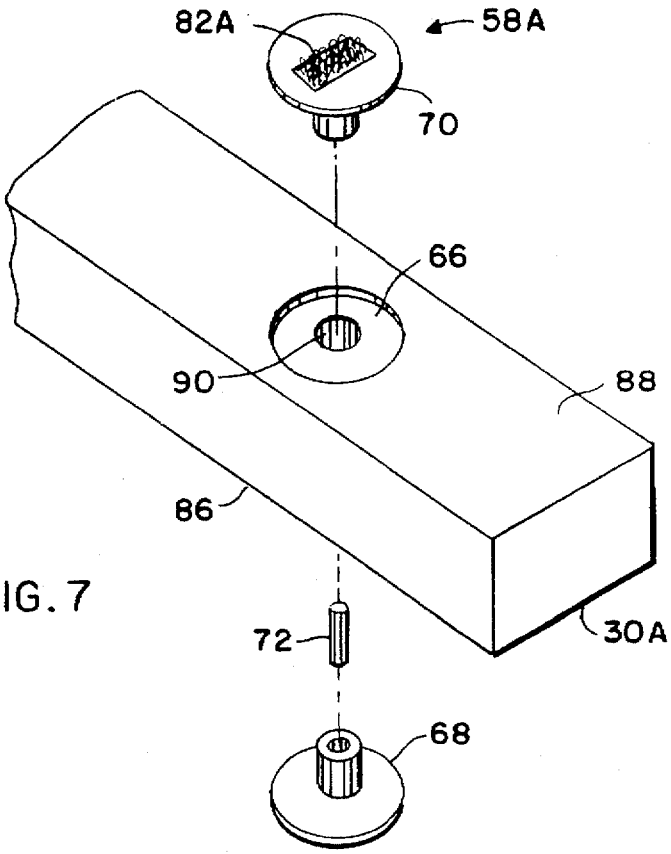
FIG. 7 is an exploded view illustrating a mount device assembled through a retaining rail.

In FIG. 7 there is illustrated an exploded view of retaining rail 30A and mount device 58A. Retaining rail 30A includes a base surface 86 and a top surface 88 which includes circular recess 66. Retaining rail 30A further includes a hole 90 extending from recess 66 in top surface 88 to recess 64 (shown in FIG. 5A) in base surface 86. Mount device 58A includes base support 68 connected to top support 70 by rod 72 through hole 90. Top support 70 recedes into recess 66 and fits snugly into hole 90. In a similar manner, base support 68 recedes into recess 64 (shown in FIG. 5A) in base surface 86 and fits snugly into hole 90.

Figure 8:
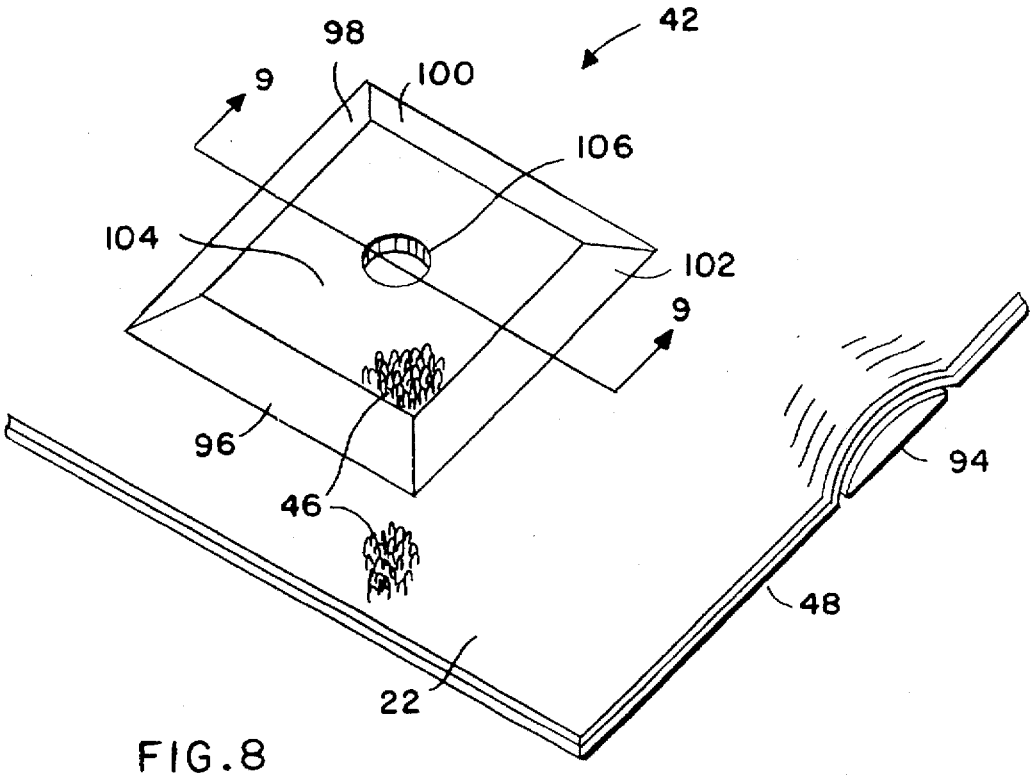
FIG. 8 is a perspective view illustrating a ball receptacle disposed on a putting mat and an undulation device placed underneath the putting mat.

In FIG. 8 there is illustrated putting mat 22, ball receptacle 42, and an undulation device 94. Both ball receptacle 42 and putting mat 22 include a top surface of loop-like fibers 46. However, ball receptacle 42 does not include the non-skid backing 48 of putting mat 22. Ball receptacle 42 further includes four access ramps 96, 98, 100, and 102 that lead to an elevated target surface 104 which includes a hole 106 of sufficient size and depth to receive and contain a putted ball. In the preferred embodiment, ball receptacle 42 is preferably 2 feet square and 1.5 inches high. Undulation device 94 is preferably made of a flexible material such as polyurethane foam or any other material that can be repeatedly walked on without fracturing. An undulation device may be of any size and shape necessary to provide different contours of a putting mat.

Figure 9:
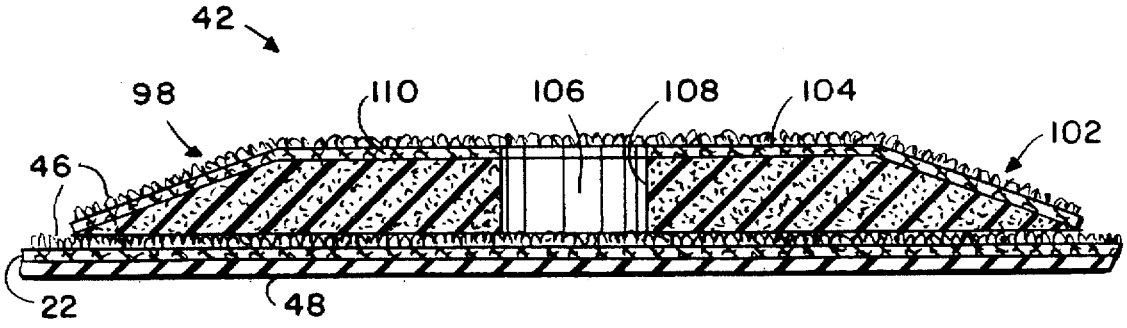
FIG. 9 is a cross-sectional view of the ball receptacle and the putting mat taken along line 9—9 of FIG. 8.

In FIG. 9 there is illustrated a cross-sectional view in detail of FIG. 8 showing ball receptacle 42 disposed on putting mat 22. Ball receptacle 42 includes a base 108 upon which is securely attached ball receptacle covering fabric 110. Preferably, ball receptacle covering fabric 110 is selected from the same materials that are suitable for the top surfaces of putting mats 22 and 24. However, because it is not necessary that fabric 110 have the capability of holding hook-like fasteners, many other fabrics may be utilized. In the preferred embodiment, base 108 is made of a flexible, yet firm, polyurethane foam with approximately a 160 IFD firmness and a density of approximately 2.3 lbs/cubic foot although any other material that can be repeatedly walked on without fracturing may be used. Access ramps 98 and 102 lead to elevated target surface 104 which includes hole 106. The depth of hole 106 may be less than the diameter of the ball to be contained therein and still allow for the successful containment of a putted ball. Ball receptacle covering fabric 110 and putting mat 22 form a continuous path for travel of the ball from putting mat 22 onto the ball receptacle 42 and vice versa.

The ball receptacle may be placed anywhere on a putting mat without the use of fasteners due to the friction between the foam base and the loop-like fibers of the putting mat. However, hook-like projections may be disposed on the underside of the foam base of the ball receptacle to provide an even stronger hold to the putting mat. A ball receptacle may be of various sizes or shapes and a plurality of ball receptacles may be used to form more than one hole at any given time.

Figure 10:
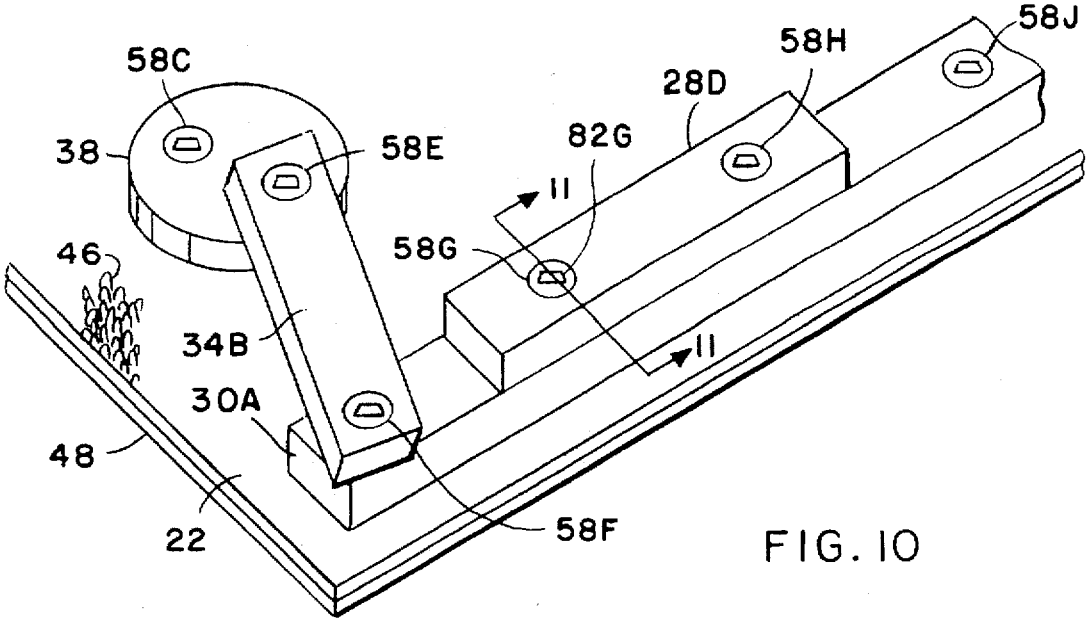
FIG. 10 is a perspective view illustrating a stacking configuration of retaining rails and an obstacle.

In FIG. 10 there is illustrated putting mat 22, three retaining rails 28D, 30A, and 34B, and an obstacle 38. Retaining rail 30A and obstacle 38 are detachably attached to loop-like fibers 46 of putting mat 22 using several mount devices of which two are shown as mount devices 58C and 58J. Retaining rail 34B is stacked onto obstacle 38 and retaining rail 30A using four mount devices of which two are shown as mount devices 58E and 58F. Retaining rail 28D is stacked onto retaining rail 30A using four mount devices of which two are shown as mount devices 58G and 58H. Mount device 58G has disposed on its top surface a plurality of loop-like fibers 82G. Loop-like fibers are preferably incorporated in a strip in a fashion similar to the hook-like projections described in connection with FIG. 5A. In a similar fashion, mount devices 58C, 58E, 58F, 58H, and 58J all have disposed on their respective top surfaces a plurality of loop-like fibers. The function of the loop-like fibers disposed on the top surface of each mount device is to enable stacking of retaining rails and obstacles upon each other and is described in more detail in FIG. 11. This allows a player additional design flexibility to create tunnels for the ball to pass through or higher retaining walls to retain a ball that is moving at high speed.

Figure 11:
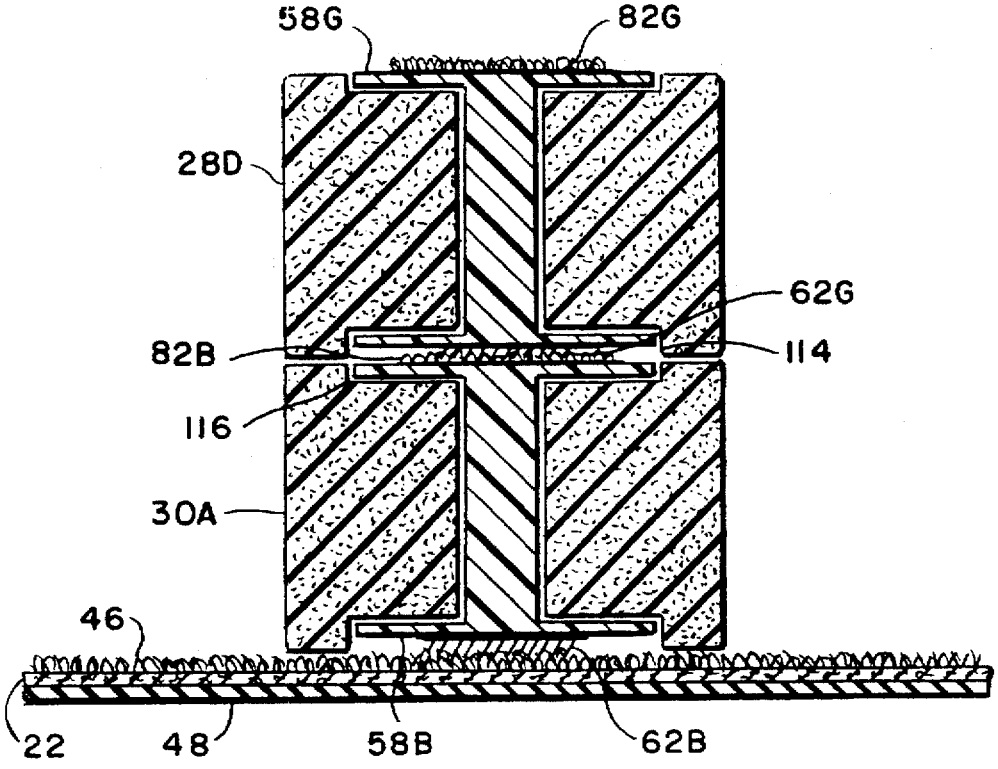
FIG. 11 is a cross-sectional view of stacked retaining rails taken along line 11—11 of FIG. 10.

In FIG. 11 there is illustrated a cross-sectional view in detail of FIG. 10 showing the stacking arrangement of retaining rails 28D and 30A at the location of mount device 58G. As shown in FIGS. 10 and 11, retaining rail 28D is detachably attached in a stacked manner to the top of retaining rail 30A which is detachably attached to putting mat 22. Referring again to FIG. 11, retaining rail 30A is attached to putting mat 22 at the point of mount device 58B. Hook-like projections 62B disposed on the underside of mount device 58B interlock with mating loop-like fibers 46 of putting mat 22 which results in the detachable attachment of retaining rail 30A to putting mat 22. Retaining rail 28D includes a circular recess 114 on its underside. Retaining rail 28D is detachably attached to retaining rail 30A at the location where hook-like projections 62G disposed on the underside of mount device 58G interlock with mating loop-like fibers 82B disposed on the top surface of mount device 58B.

An optional circular recess 116 in retaining rail 30A is used to snug mount device 58B into a position that places the top of mount device 58B level with the top of retaining rail 30A so that the top of mount device 58B does not interfere with the flat placement of retaining rail 28D onto retaining rail 30A. Mount device 58G of retaining rail 28D has disposed on its top surface a plurality of loop-like fibers 82G which enable for possible further stacking. Stacking is possible with retaining rails and obstacles in numerous combinations.

Figure 12A:
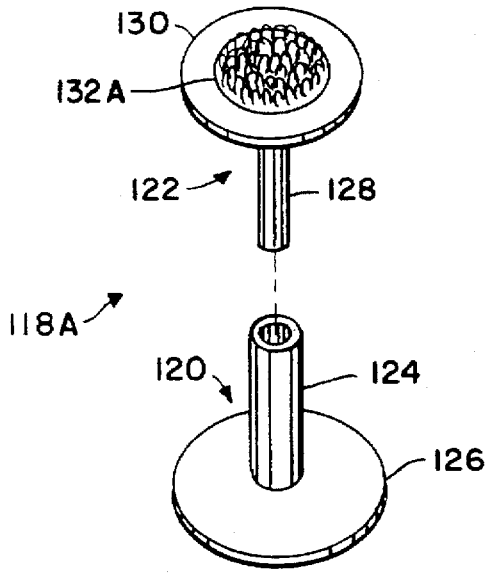
FIGS. 12A and 12B are exploded views illustrating another embodiment of a mount device used to support hook or loop fasteners.
Figure 12B:
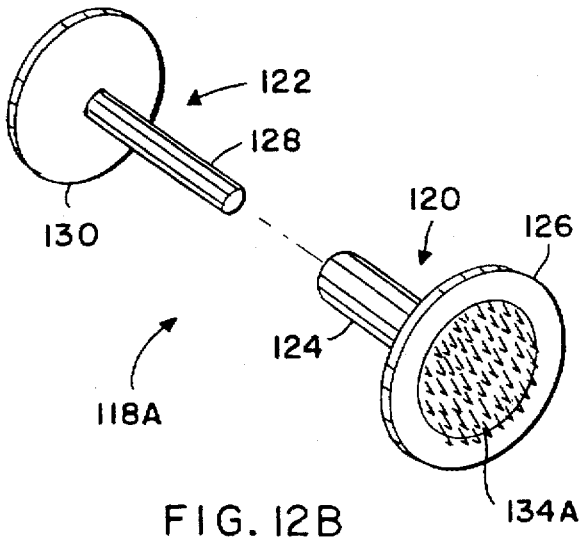

In FIG. 12A there is illustrated an exploded view of a mount device 118A that is an alternative to the mount devices represented by mount device 58A as described in FIGS. 6A and 6B. Mount device 118A comprises a base support 120 and a top support 122. Preferably, base support 120 and top support 122 are of a flexible, rubber material construction similar to practice golf tees found at golf driving ranges and may be of any other suitable material that can be repeatedly bent without fracturing. Base support 120 comprises a hollow neck 124 connected to a base cap 126. Base cap 126 has disposed on its underside a plurality of hook-like projections as shown in FIG. 12B. Top support 122 comprises a solid shaft 128 connected to a top cap 130. Preferably, top cap 130 has a diameter smaller than the diameter of base cap 126. Top cap 130 has disposed on its top surface a plurality of loop-like fibers 132A. Shaft 128 fits snugly into hollow neck 124. This fit may be improved upon through the use of adhesives. In the preferred embodiment, mount device 118A, when assembled, has a length of preferably 1.875 inches, base cap 126 has a diameter of preferably 2 inches and top cap 130 has a diameter of preferably 1.5 inches. Optionally, shaft 128 and hollow neck 124 may be threaded to provide a firm fit by screwing shaft 128 into hollow neck 124 Alternatively, shaft 128 may include protrusions that provide for a firm fit into hollow neck 124 containing grooves or notches. Mount devices may also take the form of a one-piece device incorporated into or during the molding process of the retaining rails.

While two specific embodiments of mount devices have been disclosed, each with its own particular advantages, other embodiments are possible and fall within the scope of the present invention. For example, the recess 66 used in conjunction with three-piece mount device 58A could also be used with a two-piece mount device such as mount device 118A. Similarly, the use of top and base caps of different diameters, as utilized on two-piece mount device 118A, could also be utilized on a three-piece mount device such as 58A.

In FIG. 12B there is illustrated another exploded view of mount device 118A from a different perspective. Base cap 126 of base support 120 has disposed on its underside a plurality of hook-like projections 134A which interlock with mating loop-like fibers of the putting mats.

Figure 13:
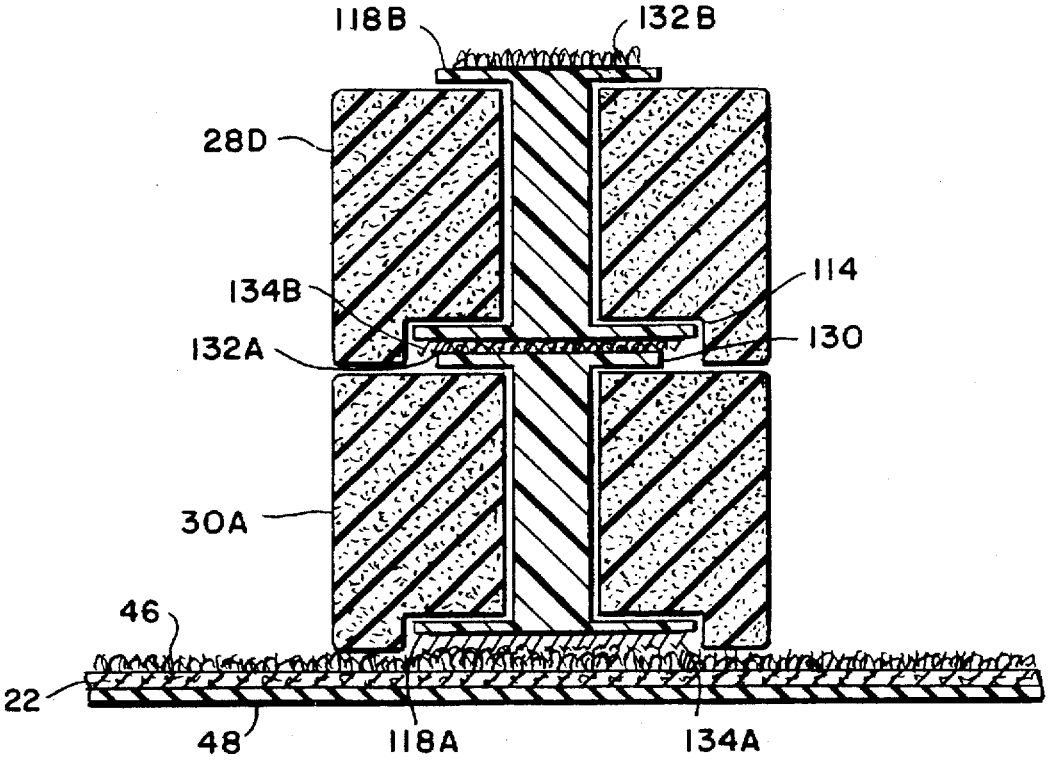
FIG. 13 is a cross-sectional view illustrating an alternate embodiment of stacked retaining rails wherein the alternative mount devices of FIGS. 12A and 12B are utilized.

In FIG. 13 there is illustrated the stacking arrangement of retaining rails 28D and 30A using alternative mount devices 118A and 118B. Mount device 118B has disposed on its underside a plurality of hook-like projections 134B and has disposed on its top surface a plurality of loop-like fibers 132B. This alternative embodiment also includes retaining rails 28D and 30A without circular recesses on the their respective top surfaces. With circular recesses absent from the top surface of retaining rails, mount devices 118A and 118B protrude above the top surface of retaining rails 30A and 28D respectively. Although top cap 130 protrudes above the top surface of retaining rail 30A, retaining rail 28D stacks on top of retaining rail 30A in a flat manner due to the fact that top cap 130 fits into circular recess 114 of larger circumference. The depth of circular recess 114 is preferably ⅜ of an inch.

Although the description above contains many details, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A portable miniature golf game to be played with a putter and ball, comprising:

a flexible putting mat having a bottom surface, a marginal edge, and a top playing surface, said top playing surface formed substantially of loop-like fibers, a retaining rail having a top surface, a base surface, and a mount device incorporated into said retaining rail, said mount device comprising a top cap, a base cap, and a connector, said connector connecting said top cap to said base cap, said base cap having hook-like projections disposed thereon enabling said retaining rail to be detachably attached to a desired location on said putting mat when said hook-like projections interlock with said loop-like fibers of said top playing surface.

2. The portable miniature golf game of claim 1 wherein said connector passes through said retaining rail.

3. The portable miniature golf game of claim 1 wherein said connector is a rod passing through said retaining rail.

4. The portable miniature golf game of claim 1 wherein said base cap is positioned within a recess in said base surface.

5. The portable miniature golf game of claim 1 wherein said bottom surface comprises a non-skid material.

6. The portable miniature golf game of claim 1 wherein said bottom surface comprises rubber.

7. The portable miniature golf game of claim 1 further including an additional putting mat having a top playing surface comprising loop-like fibers and a marginal edge, said putting mats abutted at their respective marginal edges to form a combined playing surface that allows for a sustained roll of a ball from said flexible putting mat to said additional putting mat.

8. The portable miniature golf game of claim 7 further including securing means for detachably connecting said flexible putting mat to said additional putting mat.

9. The portable miniature golf game of claim 1 further including at least one obstacle having obstacle securing means for detachably attaching said at least one obstacle to a desired location on said top playing surface.

10. The portable miniature golf game of claim 9 wherein said obstacle securing means comprises hook-like projections disposed on an obstacle mount device incorporated into said at least one obstacle.

11. The portable miniature golf game of claim 1 further including loop-like fibers disposed on said top cap.

12. The portable miniature golf game of claim 1 further including a receptacle for a golf ball.

13. A portable miniature golf game to be played with a putter and ball, comprising:

a flexible putting mat having a bottom surface, a marginal edge, and a top playing surface consisting essentially of loop-like fibers, at least one retaining rail having a top surface, a base surface, and a mount device incorporated into said at least one retaining rail, said mount device comprising a top cap, a base cap, and a rod, said rod passing through said at least one retaining rail and connecting said top cap to said base cap, said base cap having at least one section of hook-like projections disposed thereon enabling said at least one retaining rail to be detachably attached to any desired location on said putting mat when said at least one section of hook-like projections interlocks with said loop-like fibers.

14. The portable miniature golf game of claim 13 wherein said base cap is positioned within a recess in said base surface.

15. The portable miniature golf game of claim 13 wherein said top cap is positioned substantially flush with said top surface and said base cap is positioned substantially flush with said base surface.

16. A portable miniature golf game to be played with a putter and ball, comprising: a flexible putting mat having a bottom surface, a marginal edge, and a top playing surface comprising loop-like fibers, at least one retaining rail having a top surface, a base surface, and securing means for detachably attaching said at least one retaining rail to any desired location on said top playing surface having said loop-like fibers, said securing means comprising at least one section of hook-like projections disposed on a mount device incorporated into said at least one retaining rail enabling said at least one retaining rail to be detachably attached to said putting mat when said section of at least one section of hook-like projections interlocks with said loop-like fibers of said top playing surface, said mount device comprising a top cap, and a base cap positioned within a recess in said base surface, and a rod, said rod passing through said at least one retaining rail and connecting said top cap to said base cap, said at least one section of hook-like projections disposed on said base cap.

* * * * *